US007314396B2

(12) United States Patent
Kubota et al.

(10) Patent No.: US 7,314,396 B2
(45) Date of Patent: Jan. 1, 2008

(54) OUTBOARD MOTOR

(75) Inventors: Mitsuaki Kubota, Saitama (JP); Akiko Ichikawa, Saitama (JP); Koji Yasuda, Saitama (JP); Shigeo Terada, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/411,417

(22) Filed: Apr. 20, 2006

(65) Prior Publication Data

US 2006/0240723 A1 Oct. 26, 2006

(30) Foreign Application Priority Data

Apr. 26, 2005 (JP) ..... 2005-127558
May 25, 2005 (JP) ..... 2005-152134

(51) Int. Cl.
*B63H 23/00* (2006.01)
*B63H 23/32* (2006.01)

(52) U.S. Cl. ..... 440/83; 440/6; 440/75

(58) Field of Classification Search ..... 440/6, 440/76, 83, 75
See application file for complete search history.

(56) References Cited

U.S. PATENT DOCUMENTS 2,291,112 A * 7/1942 Slack ..... 403/118
2,340,415 A * 2/1944 Eason ..... 192/105 BA
2,528,480 A * 10/1950 Wilson ..... 440/86
3,230,698 A * 1/1966 Nettles ..... 60/718
3,624,738 A * 11/1971 Gill ..... 440/113
4,010,377 A * 3/1977 McKenzie ..... 290/1 R
6,347,929 B1 * 2/2002 Cooper et al. ..... 417/423.7

FOREIGN PATENT DOCUMENTS

JP 11-001199 1/1999

* cited by examiner

*Primary Examiner*—Sherman Basinger
(74) *Attorney, Agent, or Firm*—Carrier Blackman & Associates, P.C.; Joseph P. Carrier; William D. Blackman

(57) ABSTRACT

In an outboard motor mounted on a stern of a boat, comprising a power source and a driven unit including a drive shaft connected to the power source and a propeller connected to the drive shaft through a gear mechanism, wherein the power source is detachably connected to the driven unit through an interlock unit, i.e., the outboard motor can be separated into a power unit housing the power source and the driven unit. Owing to this configuration, it becomes possible to provide the outboard motor that is improved in transportability or portability, can be easily mounted on a boat, and minimizes the amount of space required for storage.

12 Claims, 10 Drawing Sheets

OUTBOARD MOTOR

BACKGROUND OF THE INVENTION

1. Field of the Invention

This invention relates to an outboard motor.

2. Description of the Related Art

Relatively small outboard motors are usually mounted on a boat (hull) by the operator or a mechanic shortly before use and unmounted or removed for storage after use. Numerous techniques have therefore been devised for facilitating the work of transporting the outboard motor to the storage place and related tasks, taught, for example, by Japanese Laid-Open Patent Application No. Hei 11(1999)-001199, particularly paragraphs 0019 and 0026 and FIG. 10.

However, even relatively small outboard motors are quite bulky owing to their long vertical length and therefore should desirably be improved in portability. This bulkiness also makes mounting of the outboard motor on the boat troublesome. An outboard motor long in vertical length also takes up a lot of space when stored or transported in a vehicle.

SUMMARY OF THE INVENTION

An object of this invention is therefore to overcome the foregoing disadvantages by providing an outboard motor that is improved in portability, can be easily mounted on a boat, and minimizes the amount of space required for storage.

In order to achieve the object, this invention provides an outboard motor mounted on a stem of a boat, comprising: a power source; and a driven unit including a drive shaft connected to the power source and a propeller connected to the drive shaft through a gear mechanism, wherein the power source is detachably connected to the driven unit through an interlock unit.

BRIEF DESCRIPTION OF THE DRAWINGS

The above and other objects and advantages of the invention will be more apparent from the following description and drawings in which.

DETAILED DESCRIPTION OF THE PREFERRED EMBODIMENTS

An outboard motor according to preferred embodiments of the present invention will now be explained with reference to the attached drawings.

Figure 1:
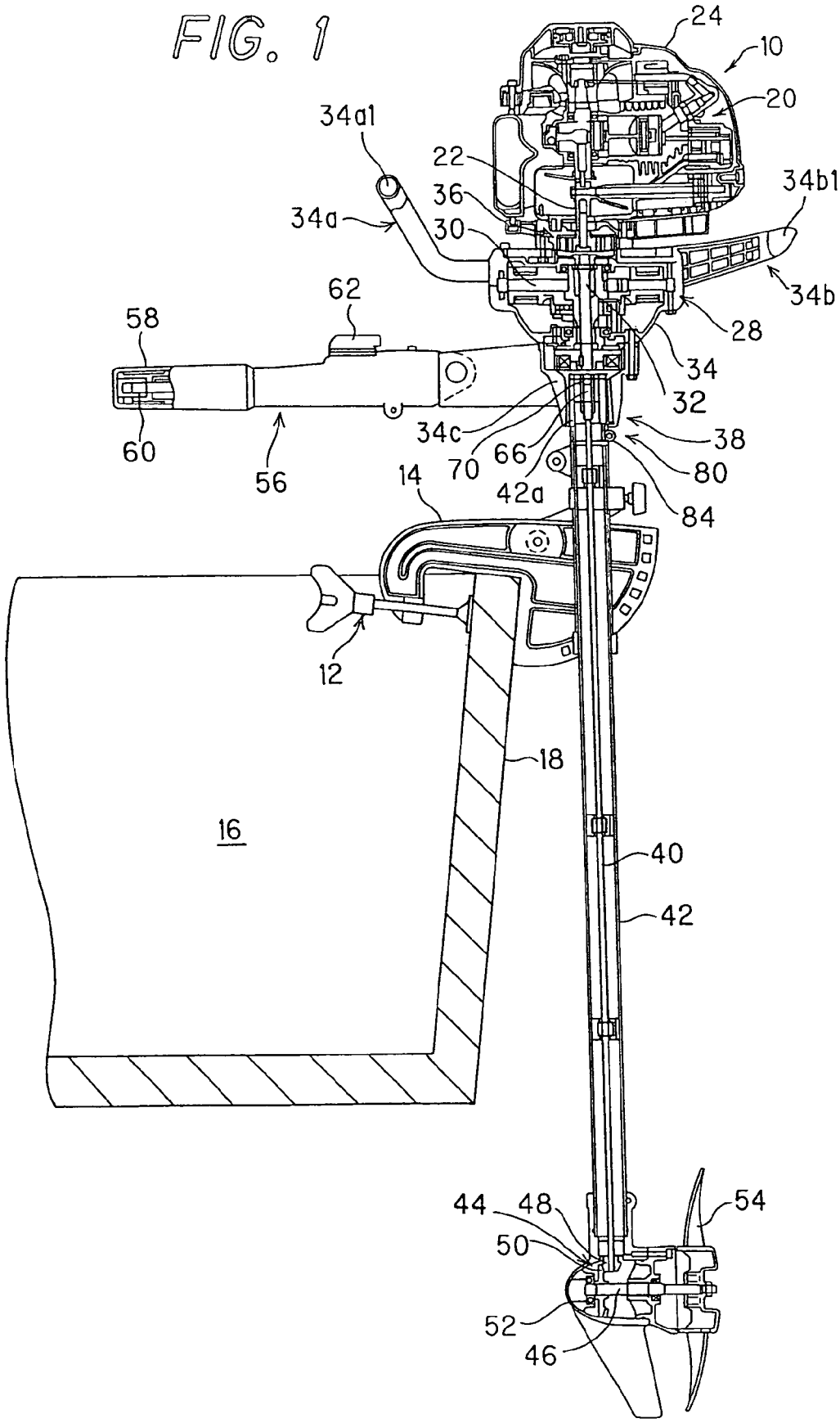
FIG. 1 is a partially sectional view showing an outboard motor according to a first embodiment of this invention.

FIG. 1 is a partially sectional view showing an outboard motor according to a first embodiment of this invention.

The outboard motor is designated by reference numeral 10 in FIG. 1. The outboard motor 10 is mounted on the stem (transom) 18 of a boat or hull 16 by means of two stem brackets 14 (only one shown in FIG. 1) equipped with a screw-type clamping device 12.

The outboard motor 10 is equipped with an internal combustion engine (power source; hereinafter called "engine") 20 at its upper portion in the vertical direction. The engine 20 is a one-cylinder gasoline engine with a displacement of about 50 cc. As shown in the drawing, the engine 20 has its crankshaft (output shaft) 22 aligned parallel to the vertical direction. The engine 20 and crankshaft 22 are enclosed by an engine cover 24.

As termed hereinafter, "vertical direction" means a direction parallel or substantially parallel to the crankshaft 22 and may differ from the gravity direction depending on the tilt angle or trim angle of the outboard motor 10. "Horizontal direction" means a direction orthogonal to the so-defined vertical direction. The horizontal direction looking toward the boat 16 from the outboard motor 10, i.e., the direction of forward travel, is defined as "forward" and the direction opposite thereof as "rearward." A horizontal direction orthogonal to the forward/rearward direction is called a "lateral direction" (left/right direction).

An electric motor (power source; generator-motor) 28 is installed in the outboard motor 10 vertically downward of the engine 20. The motor 28 is a DC brushless motor comprising a stator 30 and a rotor (output shaft) 32 and produces an output of several hundred Watts. As illustrated, the electric motor 28 has its output shaft 32 aligned parallel to the vertical direction and is enclosed by a motor cover 34 that is formed in a succession of the engine cover 24. The motor cover 34 is made of metal material having elastic deformation property, specifically made of aluminum.

As illustrated, the motor cover 34 is connected with a plurality of (specifically, two) protrusions. One protrusion connected to the front of the motor cover 34 in the forward/rearward direction is called the "first protrusion" and designated by reference numeral 34*a*. The other protrusion connected to the rear thereof is called the "second protrusion" and designated by reference numeral 34*b*.

The first protrusion 34*a* projects forward of the motor cover 34 in the substantially horizontal direction and further extends obliquely forward and upward in succession. The second protrusion 34*b* projects to rearward of the motor cover 34 in the substantially horizontal direction. The first and second protrusions formed in the foregoing manner are connected at their ends with grips 34*a*1, 34*b*1 to be grasped by the boat operator or the like.

A centrifugal clutch 36 is installed between the engine 20 and the motor 28. Specifically, the lower end of the crankshaft 22 of the engine 20 and the upper end of the output shaft 32 of the motor 28 are connected through the centrifugal clutch 36.

The upper end of a drive shaft (driven unit) 40 is detachably connected to the lower end of the output shaft 32 of the motor 28 through an interlock unit 38 (described later). As shown in the drawing, the drive shaft 40 is aligned parallel to the vertical direction and is supported within a drive shaft cover 42 to be rotatable around its vertical axis.

The lower end of the drive shaft 40 is connected to a propeller shaft 46 through a gear mechanism 44. The gear mechanism 44 comprises a pinion gear 48 disposed at the lower end of the drive shaft 40 and a bevel gear 50 disposed at a one end of the propeller shaft 46. The engagement of the pinion gear 48 with the bevel gear 50 interconnects the drive shaft 40 and the propeller shaft 46.

The gear mechanism 44 and propeller shaft 46 are covered by a gear case 52 installed at the lower portion of the drive shaft cover 42 and the propeller shaft 46 is supported to be rotatable around the horizontal axis in the gear case 52. The other end of the propeller shaft 46 on the opposite side from the one end equipped with the bevel gear 50, i.e., the rear end of the propeller shaft 46, projects from the gear case 52 to rearward of the outboard motor 10 and is attached with a propeller (driven unit) 54. Thus, the drive shaft 40 connected to the engine 20 and motor 28 (power source) is connected via the gear mechanism 44 to the propeller 54.

The output (rotational output) of the motor 28 is transmitted through the interlock unit 38, drive shaft 40 and gear mechanism 44 (pinion gear 44 and bevel gear 50) to the propeller shaft 46 to rotate the propeller 54, thereby producing thrust for driving the boat 16 forward or rearward.

The output (rotational output) of the engine 20 is transmitted through the centrifugal clutch 36 to the output shaft 32 of the motor 28 and then, like the output of the motor 28, through the interlock unit 38, drive shaft 40 and gear mechanism 44 to the propeller shaft 46 to rotate the propeller 54, thereby producing thrust for driving the boat 16 forward or rearward. In other words, the propeller 54 is rotated by either or both of the output of the engine 20 and the output of the motor 28.

Thus the outboard motor 10 comprises a hybrid outboard motor mounted on the boat 16 that is equipped with the engine 20 and motor 28 as power sources of the propeller 54. More specifically, it is a small outboard motor equipped with the engine 20 having a displacement of about 50 cc and the electric motor 28 having an output of several hundred Watts, and with the driven unit having the drive shaft 40 and propeller 54 that is attached to the boat 16 through the stern brackets 14.

The outboard motor 10 is equipped with a bar handle or tiller 56 installed below the first protrusion 34*a*. As illustrated, the bar handle 56 projects from the motor cover 34 in the forward direction so as to be operable by the boat operator. The drive shaft cover 42 is supported by the stern brackets 14 to be rotatable around its vertical axis, so that the operator can steer or maneuver the outboard motor 10 left and right by swinging the bar handle 56 horizontally, more exactly, laterally.

The bar handle 56 is provided at its end with a throttle grip 58 that can be rotated by the operator and that internally incorporates a rotation angle senor or volume sensor 60. The rotation angle senor 60 outputs a signal indicative of the rotation angle or manipulated variable of the throttle grip 58 to a controller or an electronic control unit (not shown) comprising a microcomputer and the like. The controller changes the output of the motor 28 in response to the inputted signal, thereby regulating the speed of the boat 16.

The throttle grip 58 is connected to a throttle valve (not shown) of the engine 20 through a push-pull cable (not shown). The operator can therefore manipulate the throttle grip 58 to adjust the opening of the throttle valve, thereby controlling the speed of the engine and, by this, the speed of the boat 16.

A mode switch 62 installed near the throttle grip 58 is used by the operator to input commands for starting and stopping the power source (engine 20 and motor 28). When the mode switch 62 outputs a signal indicative of the inputted starting/stopping command to the controller, the controller controls the driving of the engine 20 and the motor 28 in response to the inputted signal.

The interlock unit 38 for enabling connection and disconnection between the lower end of the output shaft 32 of the motor 28 and the upper end of the drive shaft 40 will now be explained.

Figure 2:
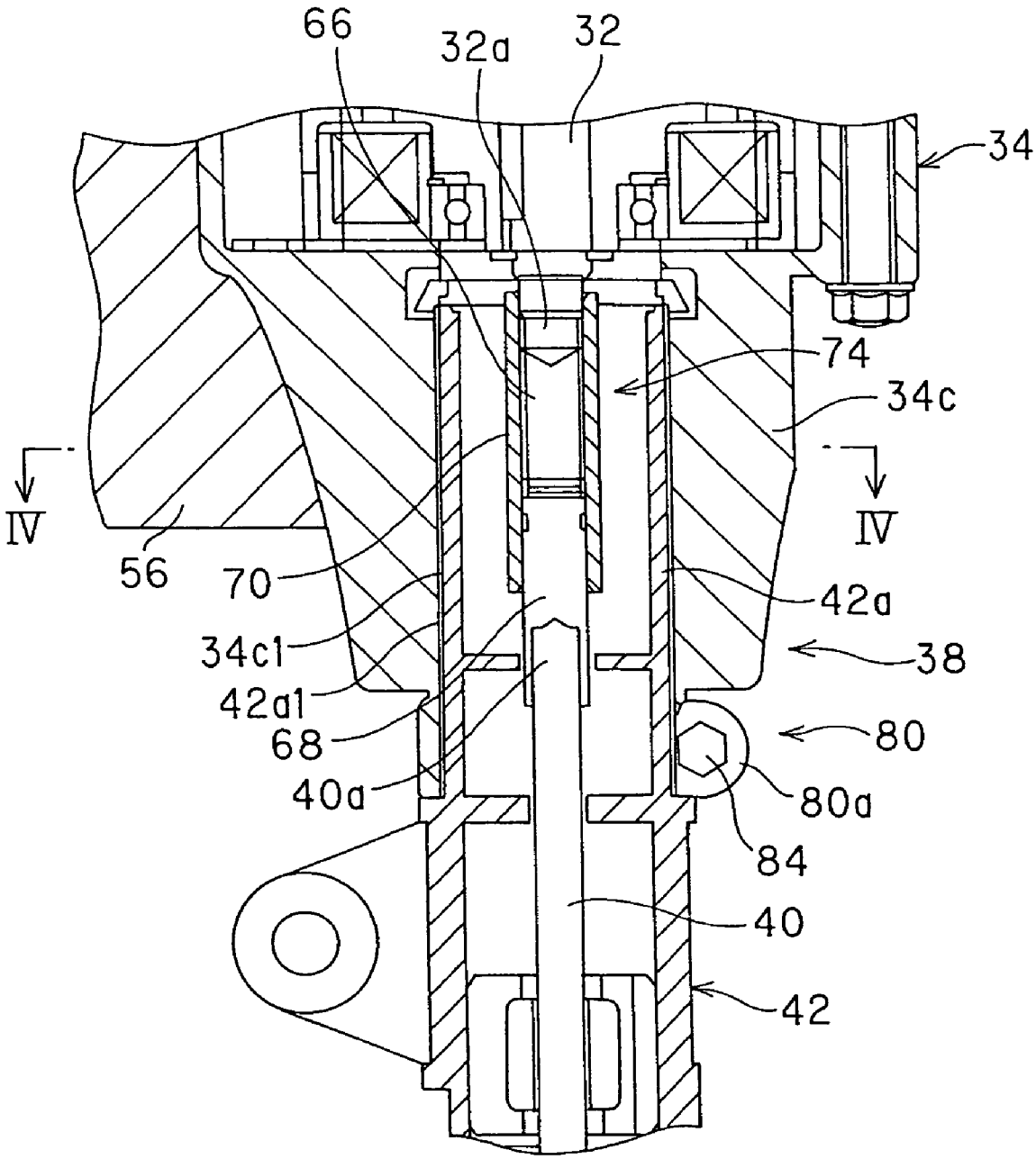
FIG. 2 is an enlarged partially sectional view of an interlock unit shown in FIG. 1.
Figure 3:
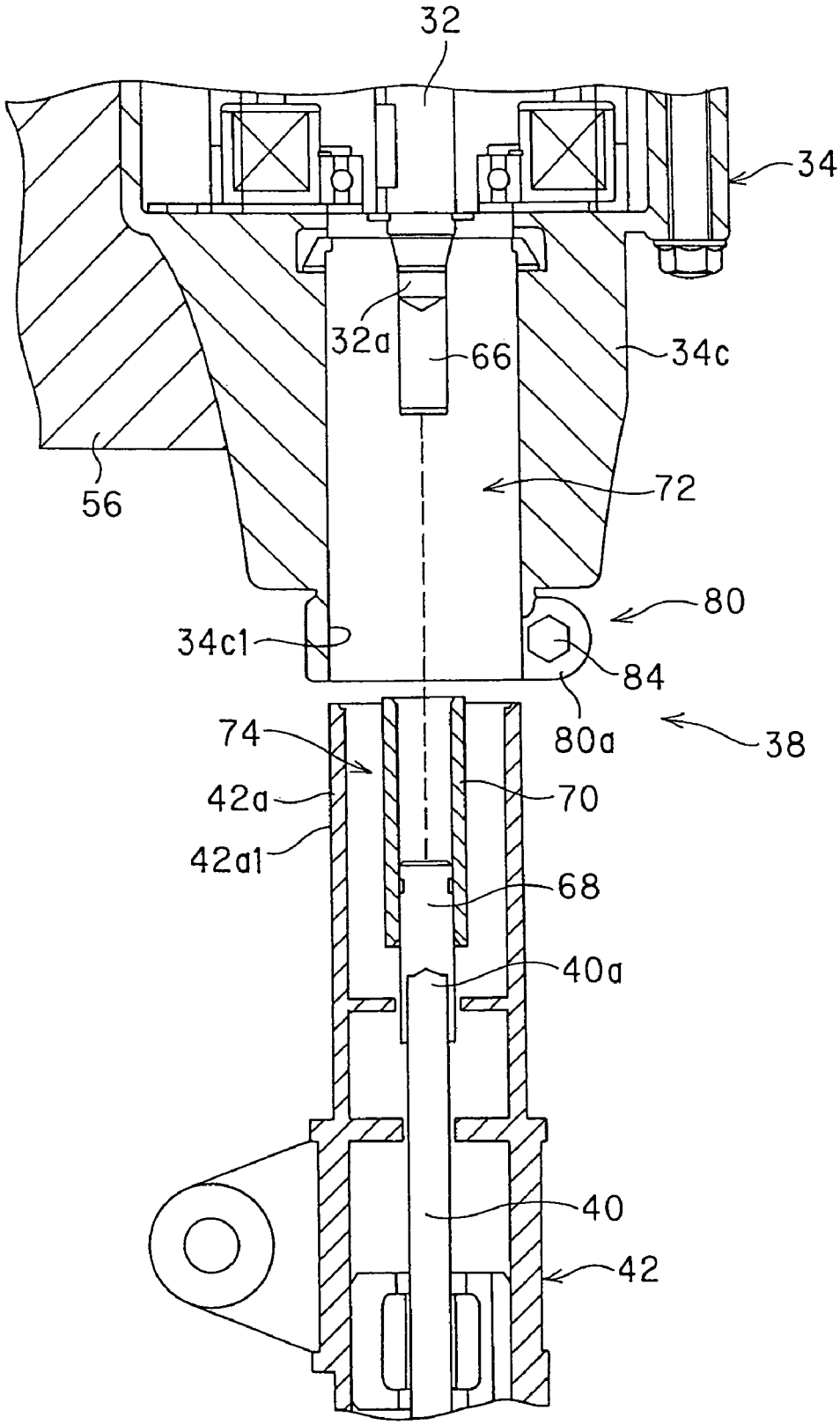
FIG. 3 is an enlarged partially sectional view similar to FIG. 2 showing the interlock unit of FIG. 2 in its state of disconnecting a power source and a driven unit.

FIG. 2 is an enlarged partially sectional view of the interlock unit 38 shown in FIG. 1. FIG. 3 is an enlarged partially sectional view similar to FIG. 2 showing the interlock unit 38 of FIG. 2 in its state of disconnecting the power source and the driven unit.

As shown in FIGS. 2 and 3, the interlock unit 38 is provided with a protuberance (first interlock member) 66 formed at the lower end 32*a* of the output shaft 32 of the motor 28 and a recessed member (second interlock member) 70 fastened through a coupling member 68 to the upper end 40*a* of the drive shaft 40.

A bearing 34*c* of roughly cylindrical shape is formed near the lower end of the motor cover 34. The interior of the bearing 34*c* is formed with a space 72 (shown only in FIG. 3). The lower end 32*a* of the output shaft 32 and the protuberance 66 are situated in the space 72. The drive shaft cover 42 is formed near its upper end with a roughly cylindrical projection 42*a*. The interior of the projection 42*a* is formed with a space 74.

The upper end 40*a* of the drive shaft 40, the coupling member 68 and the recessed member 70 are situated in the interior of the projection 42*a*.

Figure 4:
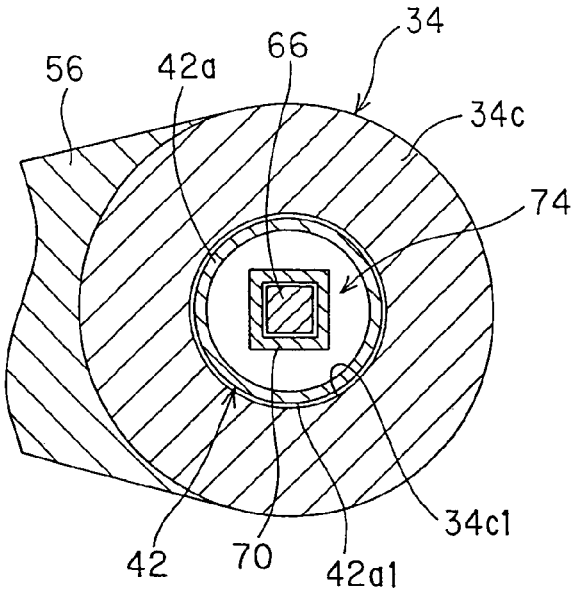
FIG. 4 is a sectional view taken along line IV-IV in FIG. 2.

FIG. 4 is a sectional view taken along line IV-IV in FIG. 2.

As shown in FIG. 4, the protuberance 66 is a solid body of polygonal (square in this embodiment) shape viewed in cross-section. The recessed member 70 is a hollow body of similar polygonal shape (roughly square in this embodiment) viewed in cross-section. The hollow interior of the recessed member 70 is shaped to enable insertion of the protuberance 66. The inner periphery of the bearing 34*c* is made slightly larger than the outer periphery of the projection 42*a*.

Figure 5:
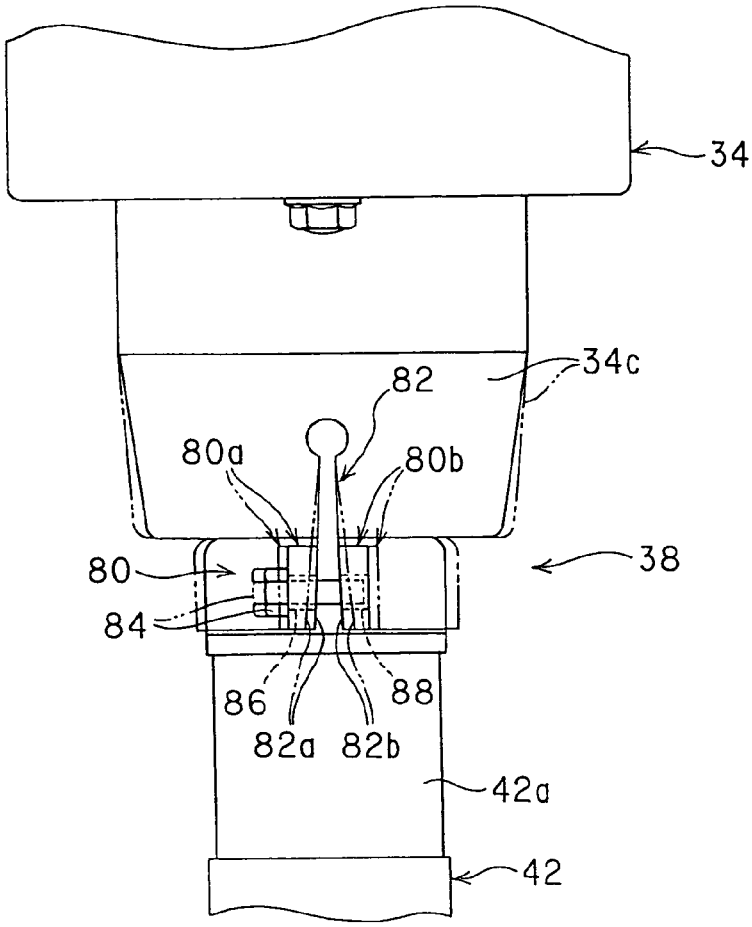
FIG. 5 is a right side view of the interlock unit shown in FIG. 2.

FIG. 5 is a right side view of the interlock unit 38 shown in FIG. 2.

A fastener 80 for fastening together the protuberance 66 and recessed member 70 is formed near the lower end of the bearing 34*c*. The fastener 80 includes a first fastener member 80*a* and second fastener member 80*b* formed to project from the side surface of the bearing 34*c*, and a gap 82 formed between the first and second fastener members 80*a*, 80*b*.

The first fastener member 80*a* is formed with a through-hole 86 for insertion of a bolt 84 and the second fastener member 80*b* is formed with a threaded hole 88 which can screw-engage the bolt 84. As shown in FIG. 5, the gap 82 is formed by cutting away the bearing 34*c* to a prescribed distance upward from its lower end. The cut-away surface on the left side as viewed in FIG. 5 will be called the "first cut-away surface 82*a*" and the cut-away surface on the right side will be called the "second cut-away surface 82*b*."

When the bolt 84 is turned in the tightening direction, the width of the gap between the first and second fastener members 80*a*, 80*b* decreases, so that the bearing 34*c* of the motor cover 34 elastically deforms to deform the gap 82. Specifically, the width of the gap between the first and second cut-away surfaces 82*a*, 82*b* is narrowed.

When the bolt 84 is loosened, the width of the gap between the first and second fastener members 80*a*, 80*b* increases, so that the bearing 34*c* of the motor cover 34 elastically deforms to deform the gap 82. Specifically, the width of the gap between the first and second cut-away surfaces 82*a*, 82*b* increases. In FIG. 5, the condition when the bolt 84 is tightened is shown in solid lines and that when it is loosened is shown in chained double-dashed lines.

The mounting of the so-configured outboard motor 10 on the boat 16 will now be explained.

Figure 6:
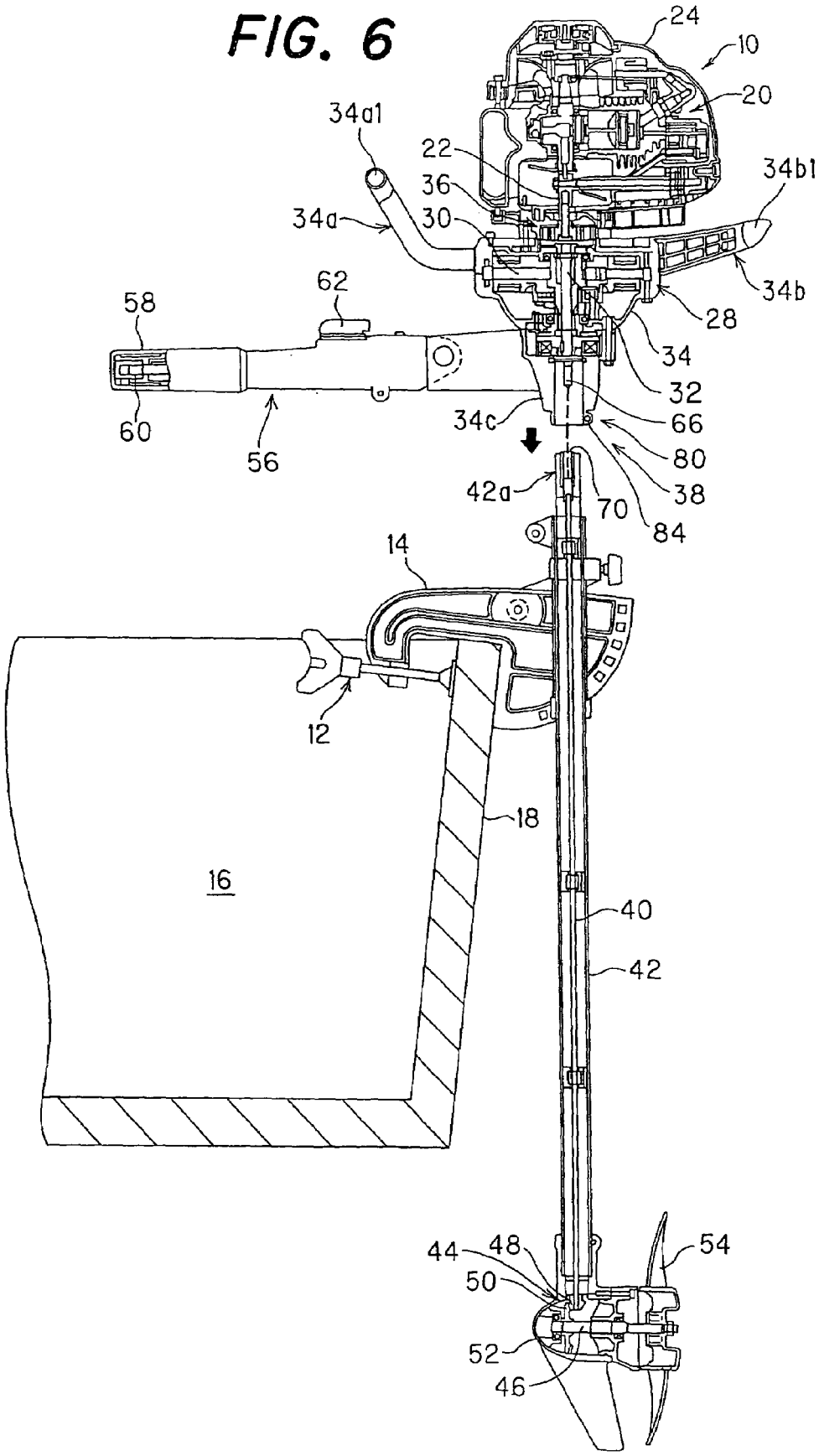
FIG. 6 is a partially sectional view of the outboard motor similar to FIG. 1 for explaining the mounting process of the outboard motor shown in FIG. 1.

FIG. 6 is a partially sectional view of the outboard motor 10 similar to FIG. 1 that will be used to explain the mounting of the outboard motor 10.

The operator, for example, operates the clamping device 12 of the stern brackets 14 to connect (fasten) the stem brackets 14 to the boat 16, thereby mounting the driven unit (drive shaft 40, gear mechanism 44, propeller 54 and so on) attached to the stem brackets 14 on the boat 16.

Next, the operator grasps the grips 34*a*1, 34*b*1 of the motor cover 34 and moves the engine cover 24 and motor cover 34 housing the power sources to above the driven unit. The operator then lowers the engine cover 24 and motor cover 34 to fit the bearing 34*c* of the motor cover 34 onto the projection 42*a* of the drive shaft cover 42 and insert the protuberance 66 of the output shaft 32 into the recessed member 70 of the drive shaft 40.

The operator then tightens the bolt 84 of the fastener 80 to narrow the gap between the first and second cut-away surfaces 82*a*, 82*b*, i.e., to shorten the inner circumference of the bearing 34*c*. As a result, the inner peripheral surface 34*c*1 of the bearing 34*c* is press-fitted or clamped onto the outer peripheral surface 42*a*1 of the projection 42*a*, thereby fastening the bearing 34*c* to the projection 42*a*.

The fastening of the bearing 34*c* to the projection 42*a* ensures that the protuberance 66 of the output shaft 32 does not detach from the recessed member 70 of the drive shaft 40, whereby the protuberance 66 and recessed member 70 are securely fastened together. As a result, a condition is established whereby the rotary output from the output shaft 32 can be transmitted to the drive shaft 40 through the interlock unit 38. The outboard motor 10 is mounted on the boat 16 by carrying out the steps explained in the foregoing.

When the outboard motor 10 is to be dismounted or removed from the boat 16, the aforesaid steps are carried out in reverse order. Specifically, the bolt 84 of the fastener 80 is loosened to widen the gap between the first and second cut-away surfaces 82*a*, 82*b*, i.e., to lengthen the inner circumference of the bearing 34*c*. This undoes the press-fitting between, or unclamps, the inner peripheral surface 34*c*1 of the bearing 34*c* and the outer peripheral surface 42*a*1 of the projection 42*a*. The fastening of the bearing 34*c* and projection 42*a* is therefore released.

The operator then grasps the grips 34*a*1, 34*b*1 and lifts the engine cover 24 and motor cover 34 to remove from the driven unit. The operator then operates the clamping device 12 of the stern brackets 14 and detaches the stem brackets 14 from the boat 16, thereby removing the driven unit (drive shaft 40, gear mechanism 44, propeller 54 and so on) from the boat 16.

As set out in the foregoing, the outboard motor 10 according to the first embodiment of this invention is configured so that the power source, i.e., the engine 20 and electric motor 28, can be detachably connected through the interlock unit 38 to the driven unit comprising at least the drive shaft 40 connected to and driven by the power source and the propeller 54 connected through the gear mechanism 44 to the drive shaft 40, i.e., so that the outboard motor 10 can be separated into the power source and the driven unit. Since this makes it possible to carry the power source and driven unit as separate units when the outboard motor 10 is transported, the bulkiness of the outboard motor 10 can be eliminated to achieve enhanced transportability (portability).

When mounting the outboard motor 10 on the boat 16, it suffices to attach the driven unit to the boat 16 and then connect the power source to the driven unit via the interlock unit 38. When unmounting the outboard motor 10 mounted on the boat 16, it suffices to disconnect the power source from the driven unit and then detach the driven unit from the boat 16. The outboard motor 10 can therefore be simply mounted on and unmounted from the boat 16.

The space required for storing the outboard motor 10 can be minimized because the outboard motor 10 can be separated into the power source and driven unit.

The interlock unit 38 comprises the protuberance 66 connected to the power source, more exactly the output shaft 32 of the electric motor 28, the recessed member 70 connected to the driven unit, more exactly the drive shaft 40, and the fastener 80 for fastening together the protuberance 66 and recessed member 70. This configuration makes it possible to fasten the power source and driven unit together securely by means of a simple structure.

Figure 7:
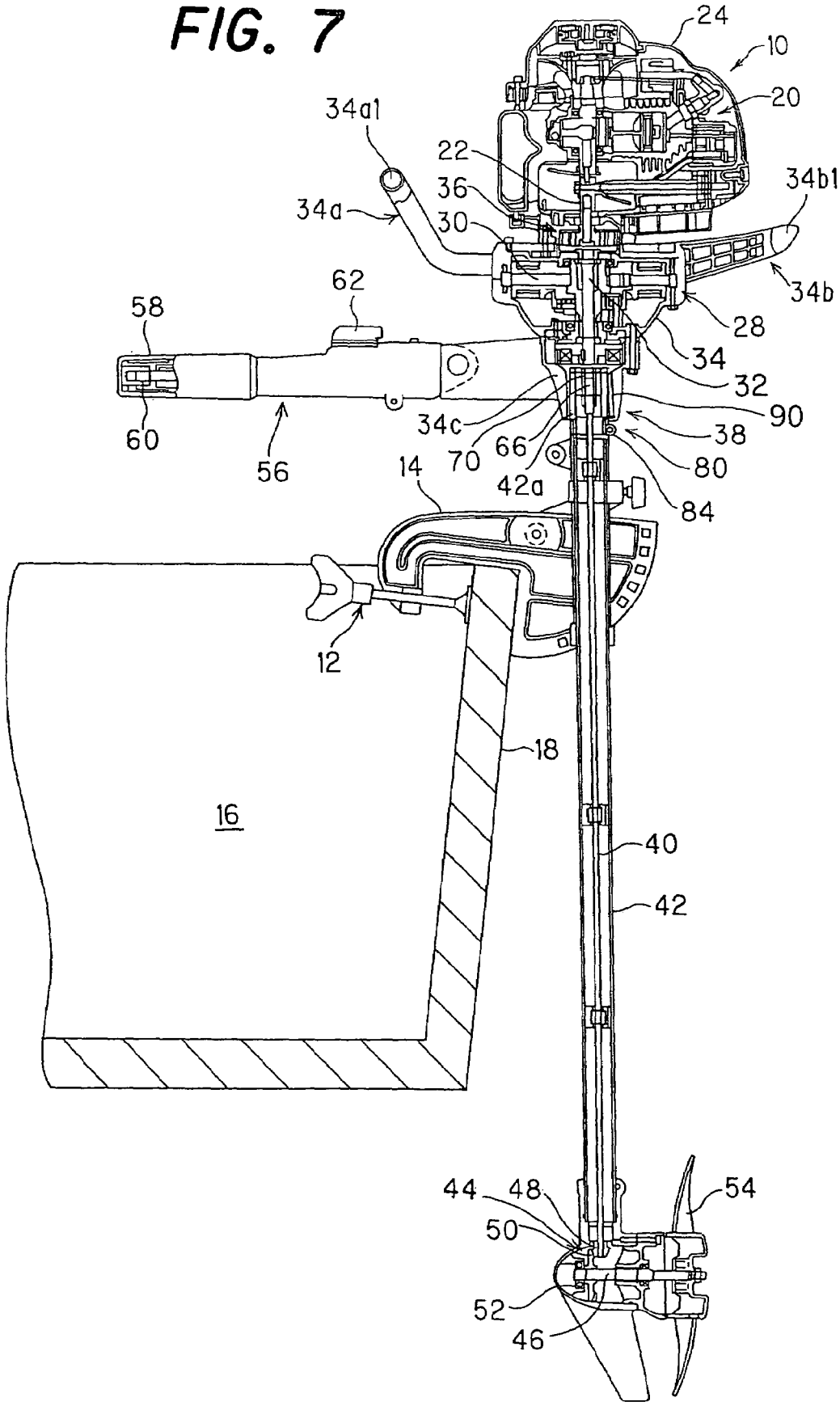
FIG. 7 is a partially sectional view showing an outboard motor according to a second embodiment of this invention.

FIG. 7 is a partially sectional view showing an outboard motor according to a second embodiment of this invention.

The explanation will be made with focus on the points of difference from the first embodiment. In the second embodiment, a rubber shock absorber (elastic body) 90 is disposed (installed) inside the bearing 34*c* formed near the lower end of the motor cover 34.

Figure 8:
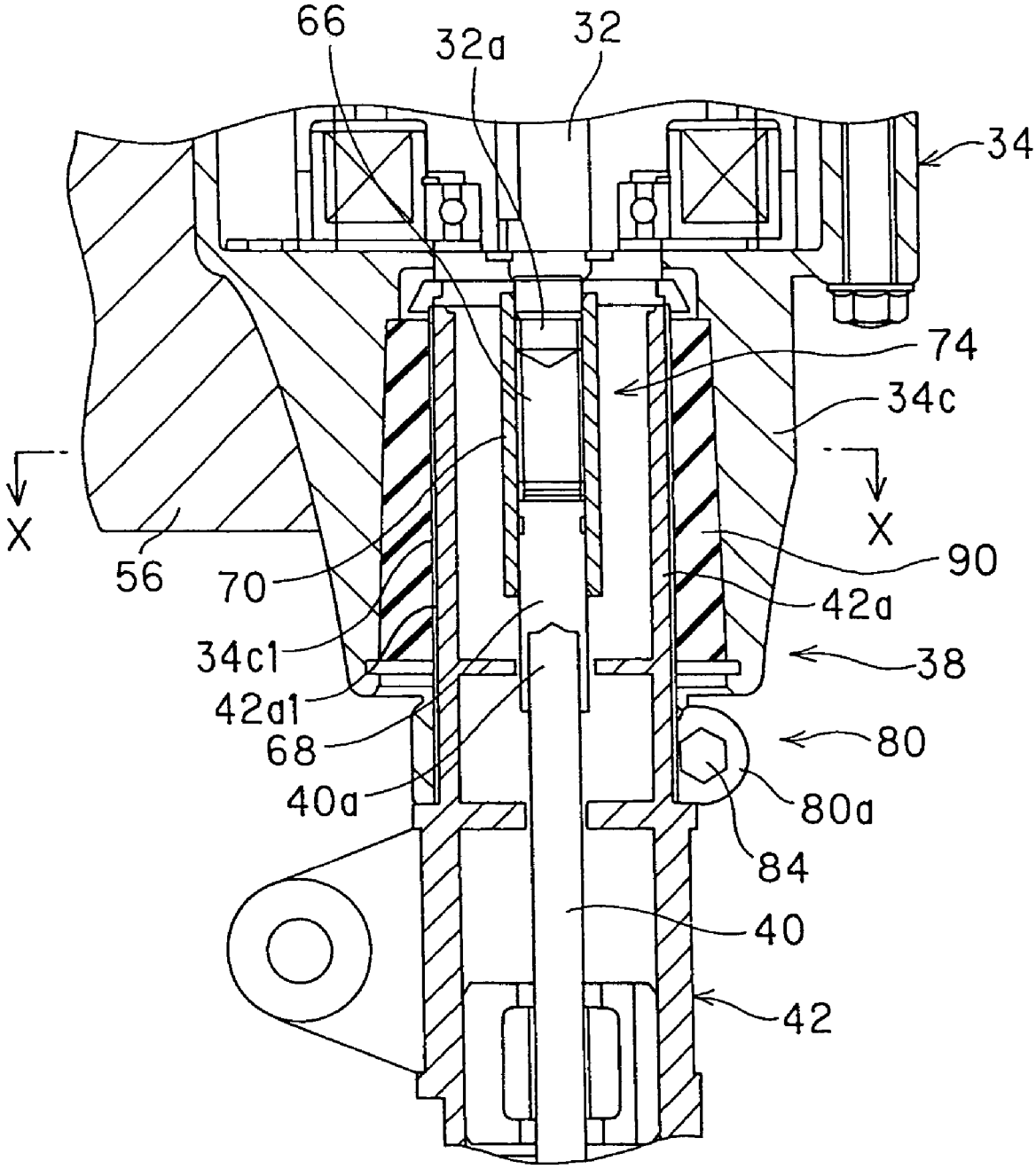
FIG. 8 is an enlarged partially sectional view of an interlock unit shown in FIG. 7.
Figure 9:
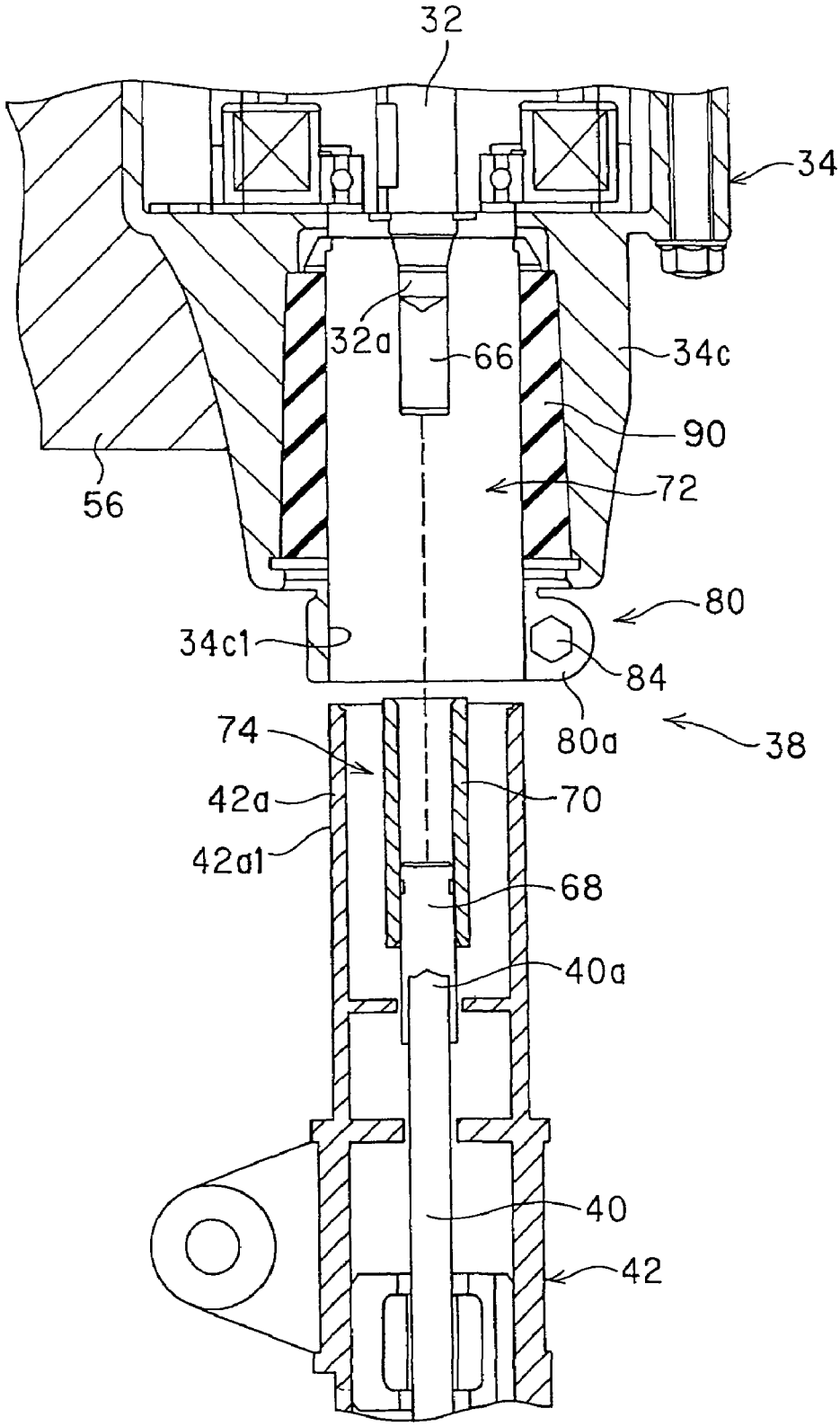
FIG. 9 is an enlarged partially sectional view similar to FIG. 8 showing the interlock unit of FIG. 8 in its state of disconnecting a power unit and a driven unit.
Figure 10:
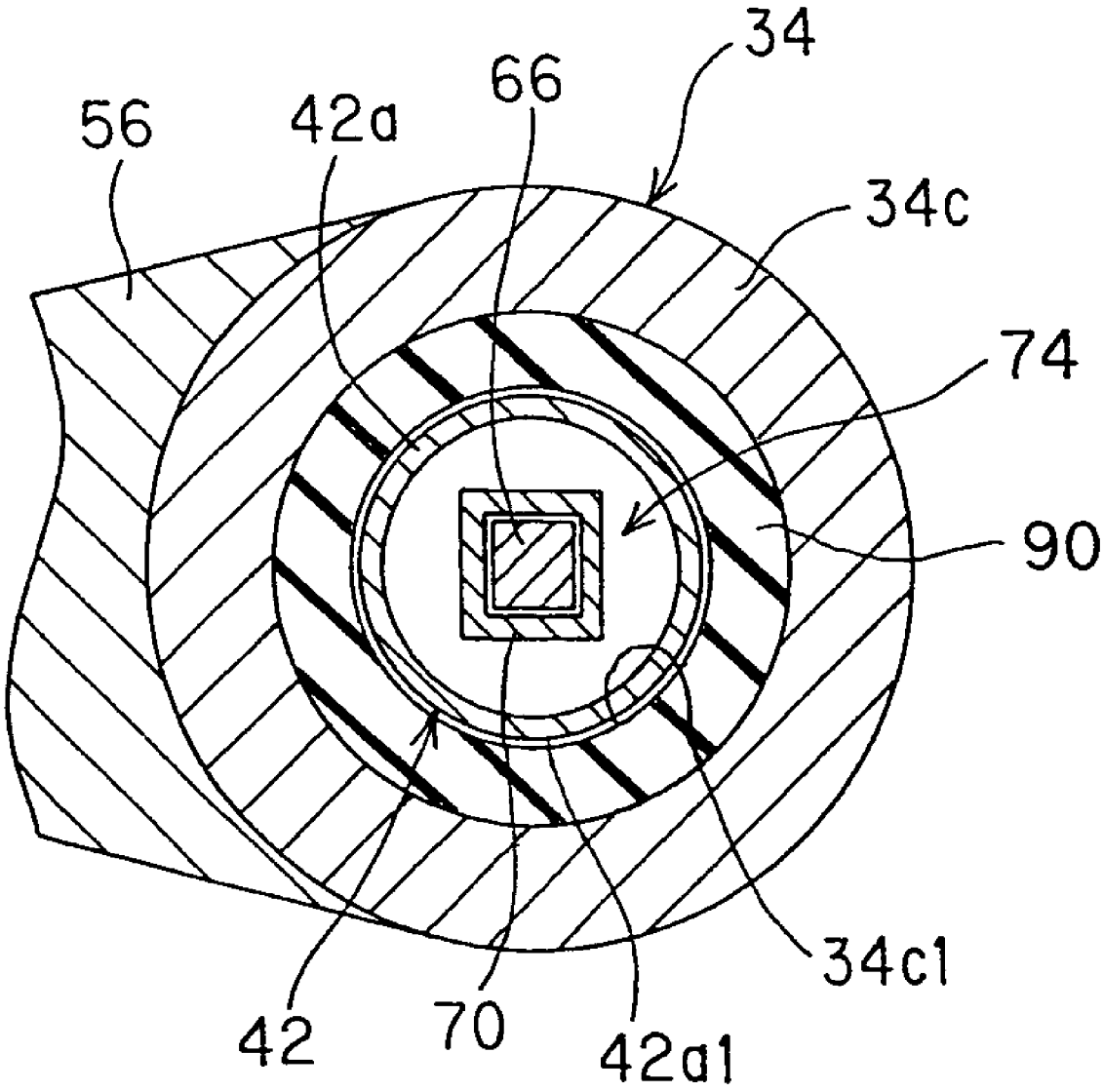
FIG. 10 is a sectional view taken along line X-X in FIG. 8.

As shown in FIGS. 8 to 10, the rubber shock absorber 90 has a roughly cylindrical shape. The rubber shock absorber 90 is made of an elastic material (specifically, chloroprene rubber) whose hardness (elasticity) is of a value capable of suppressing transmission of vibration from the power source (engine 20 and electric motor 28) to the driven unit (drive shaft cover 42), i.e., a hardness of, for example, about HS 60°.

The explanation on this will be made.

Outboard motors that use an internal combustion engine or the like as a source of power for rotating a propeller are well known. The main unit of this type of outboard motor is mounted directly on a boat. Vibration produced during operation of the power source is therefore transmitted to the hull of the boat where it generates noise. In order to minimize this vibration and noise, the outboard motor mount (apparatus for fastening the outboard motor to the boat, consisting of stern brackets, a swivel case and other members) and the main unit of the outboard motor are generally interconnected through an elastic body made of rubber or the like (see, for example, Japanese Laid-Open Patent Application No. Hei 5-278684 ('684), particularly paragraphs 0009, 0015 and 0016 and FIG. 1 etc.).

When, however, the mount and main unit of the outboard motor are interconnected through an elastic body as taught by '684, steering performance is impaired if the hardness of the elastic body is made too low (soft). This is because the outboard motor wobbles when the elastic body is spongy. Therefore, the degree of hardness to which the elastic body can be set is limited owing to, for example, the need to establish a hardness that does not degrade steering performance. The reduction of vibration and noise that can be achieved has therefore often been less than satisfactory.

In view of the foregoing drawback, it is configured in the second embodiment to provide an outboard motor capable of minimizing vibration and noise attendant upon operation of the power source without degrading steering performance.

Figure 11:
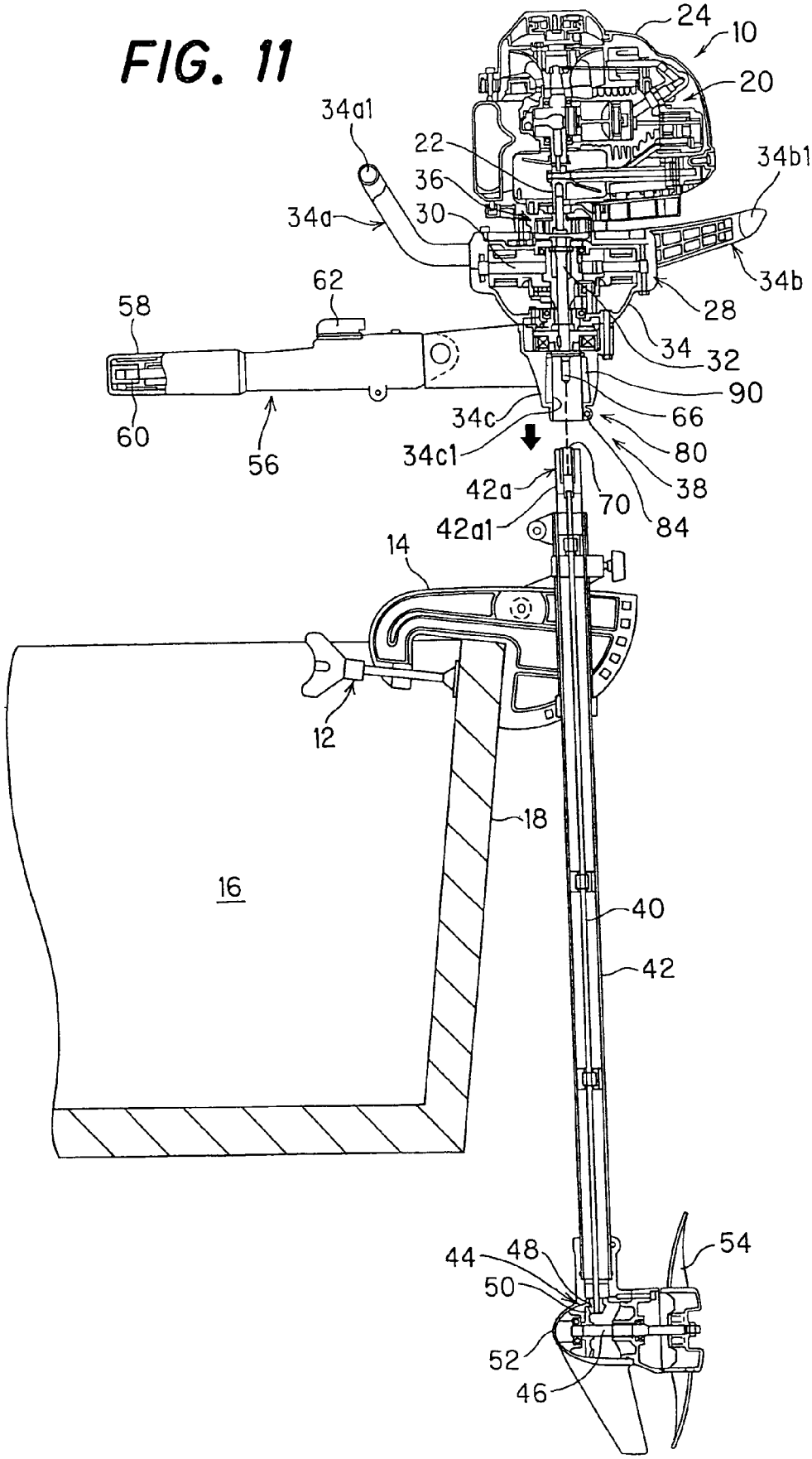
FIG. 11 is a partially sectional view of the outboard motor similar to FIG. 7 for explaining the mounting process of the outboard motor shown in FIG. 7.

FIG. 11 is a partially sectional view of the outboard motor 10 similar to FIG. 6 that will be used to explain the mounting of the outboard motor 10.

Similarly to the mounting process in the first embodiment, the operator, for example, operates the clamping device 12 to connect (fasten) the stern brackets 14 to the boat 16 and grasps the grips 34*a*1, 34*b*1 of the motor cover 34 to move the engine cover 34 and motor cover 34 (power unit) housing the power sources to above the driven unit.

Next, the operator lowers the engine cover 24 and motor cover 34 in the direction of the arrow in FIG. 11 to fit the bearing member 34*c* of the motor cover 34 onto the projection 42*a* of the drive shaft cover 42. As a result, the rubber shock absorber 90 comes to be interposed between motor cover 34 and the drive shaft cover 42.

The remaining mounting process and the structure of the outboard motor according to the second embodiment are the same as that of the first embodiment.

As set out in the foregoing, in the outboard motor 10 according to the second embodiment of this invention, the rubber shock absorber 90 is disposed inside the bearing 34*c* formed at the lower end of the motor cover 34, and the engine cover 24 and motor cover 34 housing the engine 20 and electric motor 28, and the driven unit, which is mounted on the boat 16 and comprises at least the drive shaft 40 connected to and driven by the engine 20 and electric motor 28 and the propeller 54 connected through the gear mechanism 44 to the drive shaft 40, are connected to each other through the interposed rubber shock absorber 90. Owing to this configuration, vibration from the power source, particularly the engine 20, is attenuated by the rubber shock absorber 90 to suppress transmission thereof to the boat 16, whereby vibration and noise of the outboard motor 10 produced during operation of the power source is minimized. Moreover, the rubber shock absorber 90 is not installed at the mount of the outboard motor 10, so that the hardness of the rubber shock absorber 90 has no effect on steering performance. This means that the hardness of the rubber shock absorber 90 is not subject to any particular limitation. The hardness can therefore be selected to ensure effective reduction of the vibration and noise of the outboard motor 10.

The elastic body used by the prior art to reduce outboard motor vibration and noise is fastened using bolts, washers and nuts. It therefore has a complicated structure and is not easy to install. In contrast, the elastic body of the outboard motor 10 is constituted as the rubber shock absorber 90 interposed between the power unit (motor cover 34) and the driven unit (drive shaft cover 42). It can therefore be given a simple configuration so as to be easy to install and replace.

It is configured so that one or both of the engine 20 and electric motor 28 serve as the power source. Vibration and noise of the outboard motor 10 can therefore be minimized irrespective of which of the power sources is in operation. This invention enables particularly effective reduction of the vibration and noise of an outboard motor such as the outboard motor 10, which is constituted as a relatively small hybrid outboard motor equipped with the engine 20 and electric motor 28.

The first and second embodiments are thus configured to have an outboard motor (10) mounted on a stem (1) of a boat (16), comprising: a power source (internal combustion engine 20, electric motor 28); and a driven unit including a drive shaft (40) connected to the power source and a propeller (54) connected to the drive shaft through a gear mechanism (44), wherein the power source is detachably connected to the driven unit through an interlock unit (38).

In the outboard motor, the interlock unit comprises: a first interlock member (protuberance 66) connected to the power source; a second interlock member (recessed member 70) connected to the driven unit; and a fastener for fastening together the first interlock member and the second interlock member.

In the outboard motor, an elastic body (90) is installed at the interlock unit such that a power unit housing the power source and the driven unit are interconnected through the elastic body.

In the outboard motor, the elastic body comprises a rubber shock absorber (90).

In the outboard motor, the power source comprises an internal combustion engine and an electric motor combined such that at least one of the engine and the motor is connected to the drive shaft.

In the outboard motor, the electric motor comprises a DC brushless motor having a stator (30) and a rotor (32).

In the outboard motor, the gear mechanism comprises a pinion gear (48) and a bevel gear (50).

In the outboard motor, the elastic body is made of chloroprene rubber.

Although the outboard motor 10 explained in the foregoing is configured to be divisible into two parts, namely the power source and the driven unit, it is alternatively possible to make the outboard motor 10 divisible into three or more parts by, for example, making the driven unit divisible into additional parts.

Although the fastener 80 is constituted of the first and second fastener members 80*a*, 80*b*, gap 82, bolt 84, etc., this is not a limitation and it is possible instead to use any of various other configurations capable of fastening together the bearing 34*c* and projection 42*a* so as to fasten together the protuberance 66 and recessed member 70.

In the foregoing configuration, the mounting of the outboard motor 10 on the boat 16 is accomplished by first mounting the driven unit on the boat 16 and then connecting the power unit to the driven unit. However, it also possible to adopt a configuration in which the stem brackets 14 is attached to the power unit, so that mounting is accomplished by first mounting the power unit on the boat 16 and then connecting the driven unit to the power unit.

Although the embodiment explained in the foregoing uses a DC brushless motor as the electric motor 28, a different type of motor can be used instead.

Although in the foregoing the engine 20 was said to have a displacement of about 50 cc and the electric motor 28 to have an output of several hundred Watts, the invention is not limited to these examples.

Although the centrifugal clutch 36 was said to be installed between the engine 20 and motor 28, an electromagnetic clutch or the like can be used instead.

Although the outboard motor was exemplified by the relatively small outboard motor 10 in the foregoing explanation, this is not a limitation and the invention can also be applied to a relatively large outboard motor.

Japanese Patent Application Nos. 2005-127558 filed on Apr. 26, 2005 and 2005-152134 filed on May 25, 2005 are incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An outboard motor adapted to be mounted on a stern of a boat, said outboard motor comprising:

a power source; and a driven unit including a drive shaft connected to the power source and a propeller connected to the drive shaft through a gear mechanism, wherein the power source is detachably connected to the driven unit through an interlock unit, and wherein the interlock unit comprises:

a first interlock member connected to the power source;

a second interlock member connected to the driven unit; and a fastener which fastens together the first interlock member and the second interlock member;

wherein the fastener comprises:

first and second fastener members formed outwardly of the first interlock member with a gap defined between the first and second fastener members; and a bolt which interconnects the first and second fastener members and which is manipulatable to vary a width of the gap defined between the first and second fastener members.

2. The outboard motor according to claim 1 wherein an elastic body is installed at the interlock unit such that a power unit housing the power source and the driven unit are interconnected through the elastic body.

3. The outboard motor according to claim 2, wherein the elastic body comprises a rubber shock absorber.

4. The outboard motor according to claim 2, wherein the elastic body is made of chloroprene rubber.

5. The outboard motor according to claim 1 wherein the power source comprises an internal combustion engine and an electric motor combined such that at least one of the engine and the motor is connected to the drive shaft.

6. The outboard motor according to claim 5, wherein the electric motor comprises a DC brushless motor having a stator and a rotor.

7. The outboard motor according to claim 1 wherein the gear mechanism comprises a pinion gear and a bevel gear.

8. The outboard motor according to claim 1, further comprising:

a bearing disposed coaxial around said first fastener member; and a drive shaft cover including an upper projection disposed coaxially around said second fastener member, said upper projection extends within the bearing;

wherein the first and second fastener members are formed to project from the bearing and the gap is formed in the bearing, such that when the bolt is manipulated to vary the width of the gap the bearing is elastically deformed.

9. The outboard motor according to claim 8, wherein when the bolt is manipulated to reduce the width of the gap the bearing, the bearing is clamped around and connected to the upper projection, and when the bolt is manipulated to increase the width of the gap the bearing, the bearing is unclamped and disconnected to the upper projection.

10. The outboard motor according to claim 8, wherein the bearing has an opening defined in a lower portion thereof and the upper portion of the drive shaft cover is shaped to slide into and out of the bearing opening.

11. The outboard motor according to claim 10, wherein the first and second interlock members operatively engage each other when the drive shaft cover is slid into the bearing opening.

12. The outboard motor according to claim 8, further comprising an elastic body installed between the bearing and the upper portion of the drive shaft cover for operatively interconnecting same.

* * * * *

UNITED STATES PATENT AND TRADEMARK OFFICE

CERTIFICATE OF CORRECTION

PATENT NO. : 7,314,396 B2
APPLICATION NO. : 11/411417
DATED : January 1, 2008
INVENTOR(S) : Kubota et al.

It is certified that error appears in the above-identified patent and that said Letters Patent is hereby corrected as shown below:

Under what is claimed is:

Col. 10, Claim 9, line 3:
Change "THE GAP THE BEARING" to --THE GAP OF THE BEARING--

Col. 10, Claim 9, line 5:
Change "THE GAP THE BEARING" to --THE GAP OF THE BEARING--

Signed and Sealed this

Sixth Day of May, 2008

JON W. DUDAS
*Director of the United States Patent and Trademark Office*